US007717358B2

(12) United States Patent
Noujaim

(10) Patent No.: US 7,717,358 B2
(45) Date of Patent: May 18, 2010

(54) NOZZLE FOR USE WITH THERMAL SPRAY APPARATUS

(75) Inventor: Majed Noujaim, Manchester, CT (US)

(73) Assignee: Technical Engineering, LLC, Manchester, CT (US)

( * ) Notice: Subject to any disclaimer, the term of this patent is extended or adjusted under 35 U.S.C. 154(b) by 1128 days.

(21) Appl. No.: 11/357,817

(22) Filed: Feb. 16, 2006

(65) Prior Publication Data

US 2007/0190262 A1 Aug. 16, 2007

(51) Int. Cl.
*B05B 1/24* (2006.01)

(52) U.S. Cl. ..... 239/79; 239/85; 239/135; 239/290; 239/296; 239/433; 427/446

(58) Field of Classification Search ..... 239/8, 239/13, 79, 85, 128, 135, 290, 296, 433, 239/591; 427/446, 456; 219/121.36, 121.47, 219/121.5, 121.51

See application file for complete search history.

(56) References Cited

U.S. PATENT DOCUMENTS 3,266,727 A * 8/1966 Dittrich et al. ..... 239/85
3,914,573 A 10/1975 Muehlberger
4,235,943 A 11/1980 McComas et al.
4,256,779 A 3/1981 Sokol et al.
5,340,023 A * 8/1994 Itoh et al. ..... 239/13
5,518,178 A 5/1996 Sahoo et al.
5,834,066 A * 11/1998 Kunzli et al. ..... 427/446
5,858,469 A 1/1999 Sahoo et al.
6,322,856 B1 * 11/2001 Hislop ..... 239/79

* cited by examiner

*Primary Examiner*—Steven J Ganey
(74) *Attorney, Agent, or Firm*—McCormick, Paulding & Huber LLP

(57) ABSTRACT

The present invention provides an improved nozzle assembly for use with a thermal spray apparatus for applying a coating to a workpiece. The nozzle assembly including a housing supporting a nozzle defining a gas conduit having an inlet and an outlet at opposing ends of the housing. The inlet for receiving a carrier medium from a thermal spray apparatus. The housing and the nozzle cooperating to define a material feed opening such that the material feed opening intersects the gas conduit proximate the outlet end of the nozzle. The material feed opening being angularly disposed relative to the gas conduit and intersecting the gas conduit proximate the outlet end of the nozzle such that coating material injected into the gas conduit through the material feed opening is heat-softened and propelled towards a workpiece to be coated by the carrier medium flowing outwardly from the nozzle.

17 Claims, 5 Drawing Sheets

SECTION A-A

SECTION A-A

NOZZLE FOR USE WITH THERMAL SPRAY APPARATUS

FIELD OF THE INVENTION

The present invention generally relates to thermal spray apparatus for spraying molten or heat softened material onto a workpiece at high velocities by means of high temperature carrier mediums. In particular, the present invention is directed to an improved nozzle assembly for use with a plasma generator for directing heated coating materials at high velocity against a workpiece.

BACKGROUND OF THE INVENTION

In general, thermal spraying techniques and apparatus for coating metallic substrates are well known in the art. Thermal spray processes normally include the generation of a jet of high temperature carrier medium and the injection of a coating material into the carrier medium. The coating materials are usually powders which become heat-softened or melted by the carrier medium and propelled thereby at high velocities against the surface of a substrate to be coated.

Plasma flame spray apparatus typically include a plasma generator coupled to a nozzle. A plasma stream generated by the plasma generator is passed through the nozzle and towards a workpiece. A coating material is injected into the nozzle and the plasma stream and heat-softened or melted by the plasma stream and propelled thereby towards a workpiece applying the coating material thereto.

For example, U.S. Pat. No. 4,256,779 to Sokol et al. (hereinafter referred to as "Sokol") discloses a plasma spray method and apparatus which is known in the industry as the Gator-Gard System manufactured by Sermatech International, Inc. of Limerick, Pennsylvania. Generally, the Gator-Gard System includes a plasma generator coupled with a nozzle for providing a plasma stream having improved characteristics. Upon entering the nozzle, a plasma stream is passed through a plasma cooling zone defined by a plasma cooling passageway, to a plasma accelerating zone defined by a narrowed passageway that expands into a plasma/particle confining zone. The narrowed passageway is cooled and the powder material to be applied to a substrate is introduced into the plasma stream along the cooled narrow passageway. Thereafter the particles and the plasma stream are discharged from the apparatus.

Similarly, in U.S. Pat. No. 5,858,469 to Sahoo et al. (hereinafter "Sahoo"), a modified thermal spray apparatus and method is disclosed. Generally, Sahoo discloses that plasma spray coatings of increased hardness can be applied to a workpiece by extending the distance at which the apparatus can spray the plasma/particle stream towards the workpiece. In the Sahoo apparatus, this is achieved by lengthening the passageway which defines the plasma/particle confining zone of the nozzle of the thermal spray apparatus. Additionally, Sahoo discloses that improved coatings can be obtained by increasing the ratio of the length to the diameter of the passageway defining the confinement zone.

One known problem associated with the plasma/particle confinement zones present in the nozzles of both of the Sokol and Sahoo apparatuses is that the particles of coating materials passing through these confinement zones can become cooled too much prior to exiting the nozzle. This can cause the particles of coating material to become clumped together resulting in imperfections in the applied coatings.

Further, the confinement zone present in the above-identified prior art nozzles necessitates a nozzle portion downstream of the material feed tube. This increases the minimum distance between the outlet of the nozzle and a workpiece during use of the nozzle in a coating process.

Another disadvantage of the above-identified prior art nozzle assemblies is that the nozzle assemblies do not include means for cooling the workpiece prior to applying a coating material.

Further, the above-identified prior art nozzles do not include means for enveloping the plasma stream exiting the nozzle with pressurized air for reducing contamination of the plasma stream discharged from the nozzle.

Based on the foregoing, it is the general object of the present invention to provide a nozzle assembly for use with known thermal spray apparatus that improves upon, or overcomes the problems and drawbacks associated with prior art nozzles.

SUMMARY OF THE INVENTION

The present invention provides an improved nozzle assembly for use with a thermal spray apparatus for applying a coating to a workpiece. The nozzle assembly having a housing defining a nozzle opening through a length thereof and centered about an axis defined by the housing. A nozzle is disposed in the nozzle opening and extends substantially through the length of the housing. The nozzle defining a gas conduit extending therethrough and having an inlet for receiving a carrier medium from a thermal spray apparatus and an outlet for discharging the carrier medium towards a workpiece. A material feed opening in communication with the gas conduit is provided proximate the outlet end of the gas conduit. The housing and the nozzle cooperating to define the material feed opening extending through a sidewall of both of the housing and the nozzle, the material feed opening being angularly disposed relative to the gas conduit. The outlet end of the nozzle being proximate a juncture of the gas conduit and the material feed opening such that coating material injected through the material feed opening into the gas conduit is heat-softened and propelled towards a workpiece to be coated by the carrier medium flowing out of the nozzle. Thus, the present invention nozzle assembly does not include a plasma/particle confinement zone downstream of a material feed tube such as disclosed in the above-identified prior art nozzles for use with thermal spray apparatus.

A primary object of the present invention is to provide an improved nozzle assembly for use with a thermal spray apparatus for improving the consistency and quality of the coating materials applied therewith.

Another object of the present invention is to provide a nozzle assembly for use with a thermal spray apparatus including a housing having a tapered portion at an outlet end of the housing that converges towards the outlet of the nozzle for facilitating use of the nozzle assembly in close proximity to a workpiece and angularly disposed with respect thereto.

It is also an object of the present invention to provide a nozzle assembly including means for conveying pressurized air towards a workpiece adjacent a carrier medium and coating material flowing out of the nozzle. The pressurized air for preventing dust and other contaminates from infiltrating the plasma stream and coating material discharged from the nozzle prior to contacting the workpiece. The pressurized air can be used for cooling the workpiece prior to and after applying the coating material.

It is also an object of the present invention to provide a nozzle assembly including an improved tip portion of increased hardness for reducing the wear and erosion of the tip portion due to the coating materials and plasma stream passing therethrough.

A further object of the present invention includes a method for thermal spray application of a coating material to a workpiece including providing a nozzle assembly for spraying a plasma stream carrying heat-softened particles of a coating material towards a workpiece, as well as a jet of pressurized air adjacent to the plasma stream on at least two opposing sides thereof. The jets of pressurized air being directed substantially parallel to the plasma stream for preventing dust and other contaminants from infiltrating the plasma stream containing the coating material prior to contacting the workpiece.

The foregoing and still other objects and advantages of the present invention will be more apparent from the following detailed explanation of the preferred embodiments of the invention in connection with the accompanying drawings wherein throughout the figures, like reference numerals describe like elements of the invention.

DETAILED DESCRIPTION OF THE INVENTION

Figure 1:
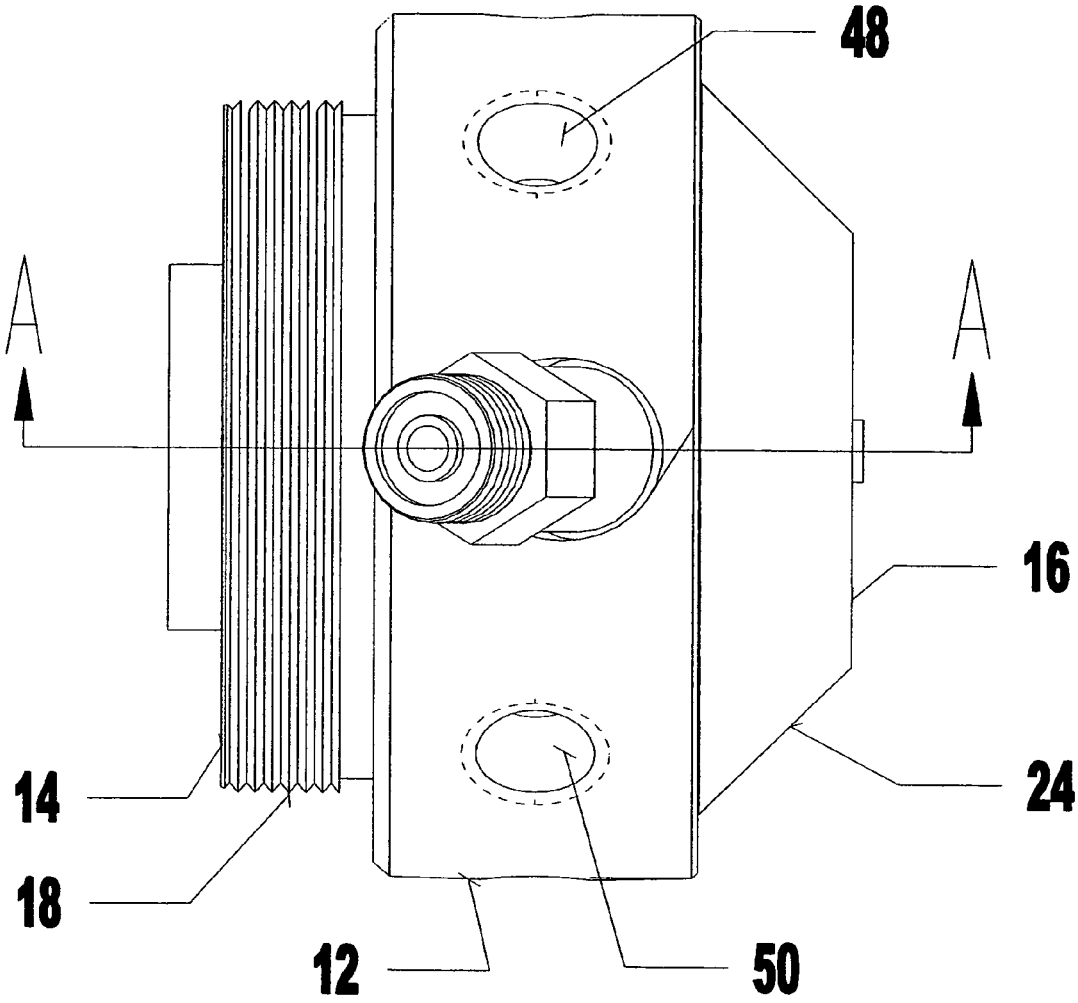
FIG. 1 is a top view of a nozzle assembly for use with a thermal spray apparatus in accordance with the present invention.

Referring to the Figures, the present invention nozzle assembly for use with a thermal spray apparatus is generally referred to with the reference numeral 10. The nozzle assembly 10 is attachable to known thermal spray apparatus such as a plasma generator (not shown) and used in conjunction therewith for applying a heat-fusible coating material to a workpiece. The nozzle assembly 10 includes a housing 12 having an inlet end 14 and outlet end 16. The housing 12 is generally cylindrically shaped and includes a threaded portion 18 at the inlet end 14 for coupling the housing and nozzle assembly 10 to a plasma generator.

Figure 2:
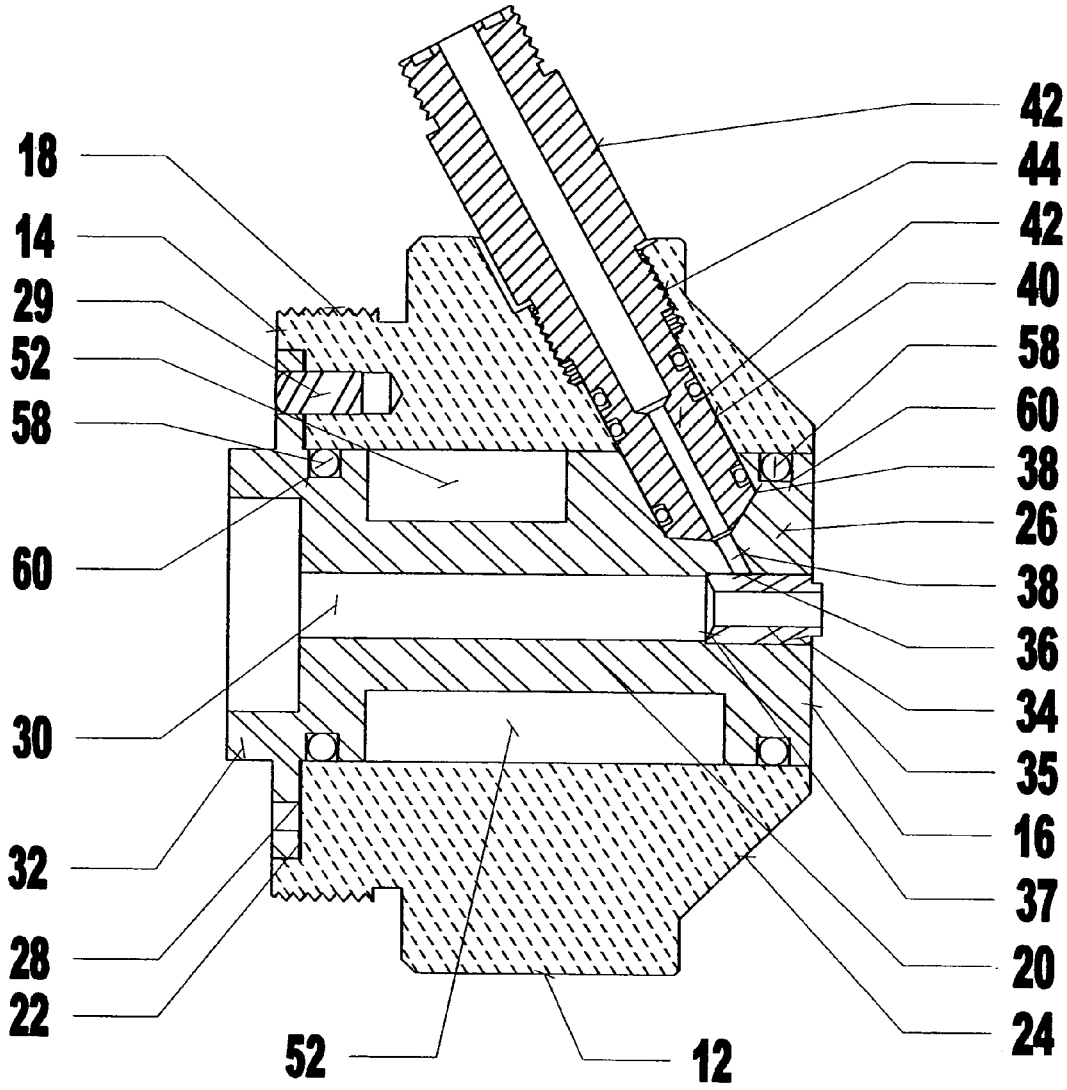
FIG. 2 is a cross-sectional view of the nozzle assembly of FIG. 1.

Referring to FIG. 2, the housing 12 defines a generally cylindrical nozzle opening 20 extending throughout a length of the housing and centered about a central axis X-X defined by the housing. An annular recess 22 is defined by the housing 12 surrounding an inlet end of the nozzle opening 20. The housing 12 further defines a tapered end portion 24 that converges toward the central axis X-X of the housing 12 at the outlet end 16 thereof. The tapered end portion 24 allows the nozzle assembly 10 to be used in close proximity to a workpiece and angularly disposed with respect to the workpiece. In certain applications, the tapered end portion 24 of the present invention nozzle assembly 10 allows a coating material to be discharged from the nozzle much closer to, or at a sharper angle relative to a workpiece than prior art nozzle assemblies.

Still referring to FIG. 2, a nozzle 26 is disposed in the nozzle opening 20. The nozzle 26 is removably insertable in the nozzle opening 20 via the inlet end 14 of the housing 12 and extends throughout the length of the housing. A shoulder 28 extending outwardly the body of the nozzle 26 near the inlet end thereof is disposed in and engages the recess 22 thereby limiting the insertion of the nozzle into the housing 12. The angular relationship between the nozzle 26 and housing 12 is fixed by an alignment pin 29 disposed in corresponding openings in the nozzle 26 and housing 12.

The nozzle 26 defines a gas conduit 30 through the length thereof for conveying a plasma stream generated by a plasma generator (not shown) through the nozzle. A flange 32 at the inlet end of the nozzle 26 is provided for receiving a plasma generator and a plasma stream therefrom. In operation, a plasma stream produced by the plasma generator, enters the gas conduit 30 at the flange 32 and passes through the nozzle via the gas conduit. The gas conduit 30 is surrounded by a cooling medium circulated through the housing 12 and in contact with an outer surface of the nozzle 26.

A nozzle tip 34 is positioned at the outlet end of the nozzle 26 and defines a gas passageway 35 in communication with the gas conduit 30. In a preferred embodiment, the nozzle tip 34 is press fit in the end of the gas conduit 30 and positioned in alignment therewith along the central axis X-X so as to receive the plasma stream traveling through the gas conduit. The nozzle tip 34 further defines a material port 36 that is angularly disposed with respect to the gas passageway 35 and in fluid communication therewith. During use of the nozzle assembly 10, a coating material is introduced to the plasma stream via the material port 36 in the nozzle tip 34. Material ports 38 and 40, defined by each of the nozzle 26 and the housing 12 respectively, are aligned with, and in fluid communication with the material port 36 formed in the nozzle tip 34.

Referring again to FIGS. 1 and 2, a material feed tube 42 is coupled to the nozzle assembly 10 for injecting a heat-fusible coating material into the plasma stream. The material feed tube 42 includes a threaded portion 44 threadably engaged with the material port 40 of the housing 12 and an end portion 42 that extends into the material port 38 defined by the nozzle 26. The material port 38 of the nozzle 26 extends through a sidewall of the nozzle and is in fluid communication with the gas passageway 35 defined by the nozzle tip 34.

In a preferred embodiment, the nozzle tip 34 is formed of a material of greater hardness than the nozzle 26 such that the nozzle tip 34 is less susceptible to wear and abrasion than the nozzle. In one embodiment the nozzle tip 34 of the present invention is formed from carbide material. Alternatively, the nozzle tip 34 could be manufactured from an air-hardened material.

The nozzle tip 34 of the present invention is much shorter than the outlet portions of the nozzles of prior art nozzle assemblies. As set forth above, both of the Sokol and Sahoo references disclose nozzles having plasma/particle confinement zones downstream of a material feed tube for allowing the plasma stream to cool following the introduction of the coating material. In contrast, the present invention nozzle tip 34 is designed to eliminate any such plasma/particle confinement zone and provides a juncture of the material port 38 of the nozzle proximate the outlet end of the nozzle tip 34 such that the coating material injected into a plasma stream traveling through the nozzle is heat-softened by the plasma stream substantially beyond the nozzle tip 34. Thus, the coating material is not cooled within the nozzle 26 of the present invention and no dumping of the coating material due to overcooling will occur. In a preferred embodiment, the material port 36 defined by the nozzle tip 34 is approximately 0.300 inches from the outlet end thereof.

As shown in FIG. 2, the nozzle tip 34 of the present invention includes a throat 35 having a reduced interior diameter than that of the gas conduit 30 upstream thereof. An angled opening 37 at an inlet of the nozzle tip 34 provides a smooth transition for the plasma stream entering the nozzle tip 34. This angular opening 37 reduces the amount of turbulence in the plasma stream entering the nozzle tip 34 and discharged therefrom resulting in increased uniformity and fewer imperfections in the coatings applied thereby.

Referring again to FIGS. 1 and 2, a coolant inlet 48 and coolant outlet 50 are defined by the housing 12 and are in fluid communication with the outer surface of nozzle 26 at the openings 52 via coolant ports 54 also defined by the housing. Typically, a coolant such as water, is circulated between the nozzle 26 and the housing 12 in the openings 52 defined between an outer surface of the nozzle 26 and the surface of the housing forming a sidewall of the nozzle opening 20.

A pair of seals 58, 58 such as O-rings, are disposed in corresponding grooves 60, 60 defined by the nozzle 26 near each of the inlet and outlet ends of the nozzle. The seals 58, 58 are provided to retain coolant circulated through the housing 12 and around the nozzle 26 from leaking from the nozzle assembly 10 at the joint between the nozzle and the nozzle opening 20.

Figure 3:
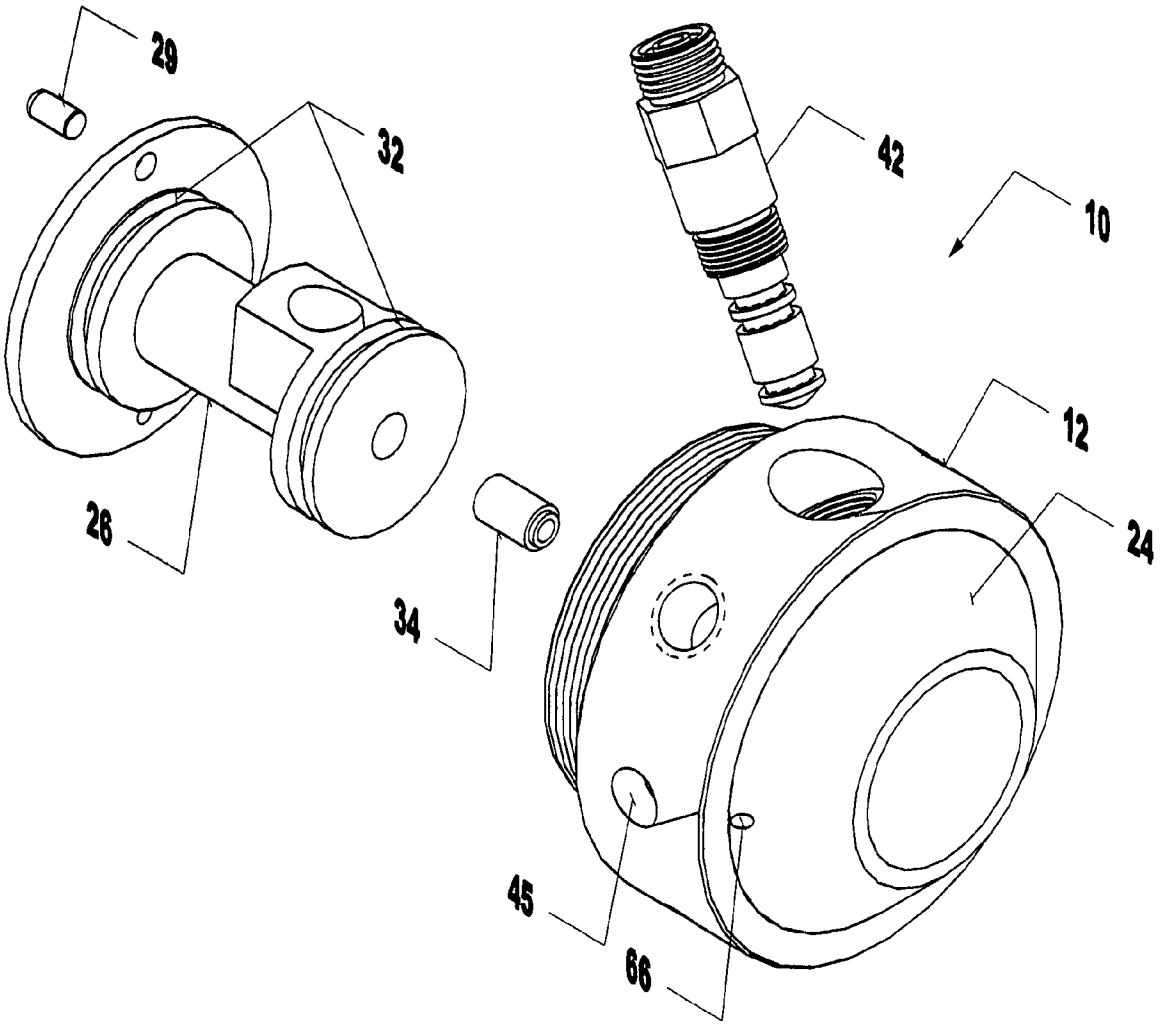
FIG. 3 is an exploded perspective view of the nozzle assembly of FIG. 1.
Figure 4:
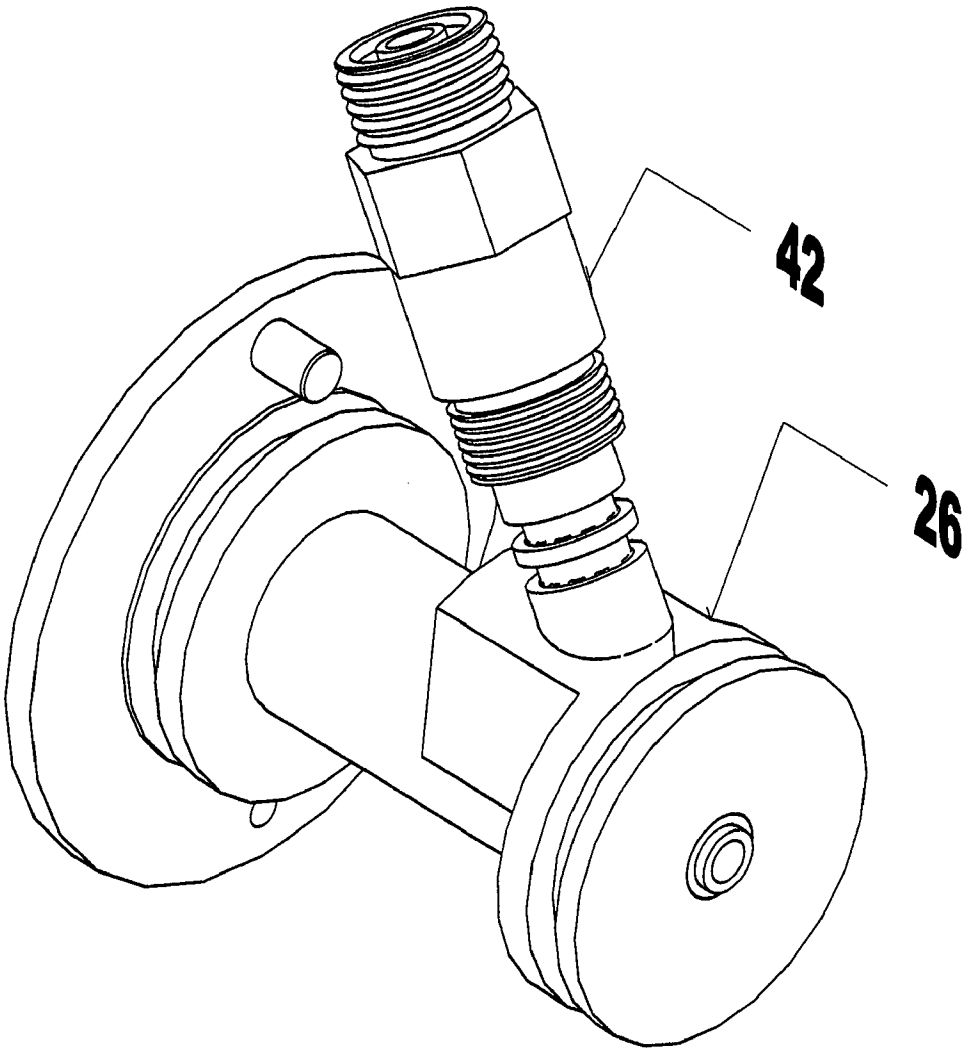
FIG. 4 is a perspective view of a nozzle and material feed tube in accordance with the present invention.
Figure 5:
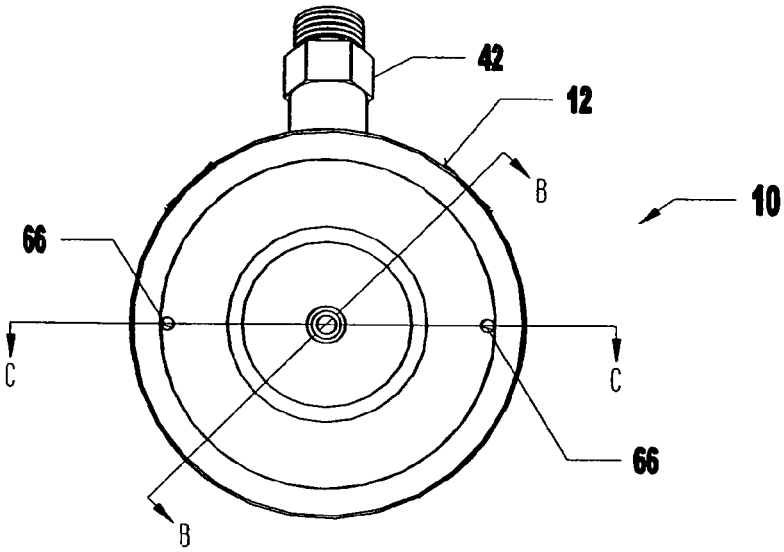
FIG. 5 is a front view of the outlet end of the nozzle assembly of FIG. 1.
Figure 6:
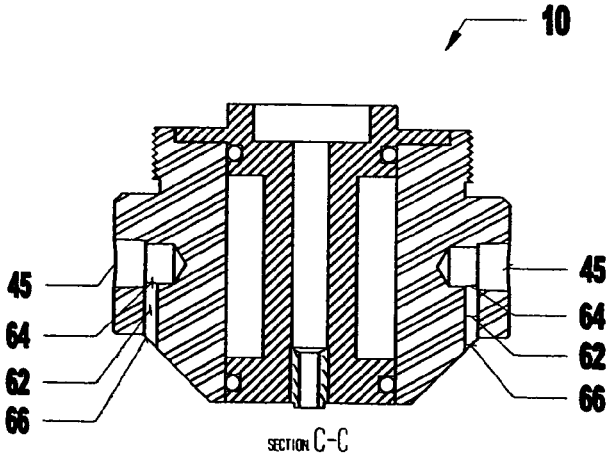
FIGS. 6 and 7 are cross-sectional views of the nozzle assembly of FIG. 5.
Figure 7:
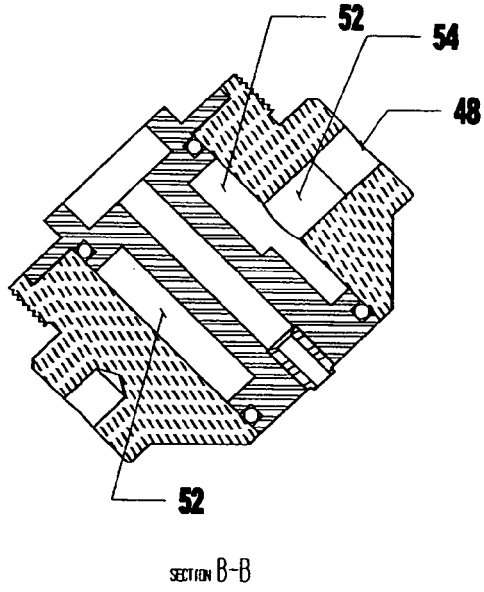

The nozzle assembly 10 of the present invention provides means for enveloping the plasma stream and coating materials discharged from the nozzle 26 in pressurized air for preventing dust and other contaminants from infiltrating the plasma stream prior to the engagement of the coating material with the workpiece. As shown in FIGS. 3 and 6, air inlet ports 45 are provided on opposing sides of the housing 12 for connection with a pressurized air source such as an air compressor (not shown). At least two air passages 62 are defined by the housing 12 and aligned substantially parallel to the gas conduit 30 and spaced apart from and on opposing sides thereof. The air passages 62 each including an inlet 64 in communication with the air inlet ports 45, and an outlet 66 extending through the housing on opposing sides of the outlet of the nozzle tip 34. The air passages 62 and outlets 66 for discharging from the nozzle assembly 10 pressurized air towards a workpiece adjacent a carrier medium and coating material flowing out of the nozzle. Additionally, the pressurized air discharged from the nozzle assembly from the air passages 62 and outlets 66 act to cool the workpiece prior to the coating process.

Further, the outlets 66 for the pressurized air discharged from the nozzle assembly 10 can be positioned to engage the workpiece forward of the plasma stream and coating material for cooling the workpiece or removing dust and contaminants from the workpiece just prior to the delivery of the coating material. For example, as shown in FIG. 6, if the nozzle assembly 10 is used in a coating process wherein the nozzle assembly is moved in sideways motion along the line A to apply a coating material, the pressurized air discharged from the outlets 66 will engage the workpiece prior to and after the coating material contacts the workpiece.

Additionally, the present invention provides a method for thermal spray application of a coating material to a workpiece including providing a nozzle assembly including means for enveloping the plasma stream and coating materials discharged from the nozzle in pressurized air for preventing dust and other contaminants from infiltrating the plasma stream prior to the engagement of the coating material with the workpiece.

Further, the method includes providing a nozzle assembly including means for discharging a jet of pressurized air for contacting the workpiece prior to and after the coating material contacting the workpiece for cooling the workpiece and/or removing any contaminants such as dust or debris from the workpiece prior to and after the coating material engaging the workpiece.

The foregoing description of embodiments of the present invention has been presented for the purpose of illustration and description, it is not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A nozzle assembly for use with a thermal spray apparatus for applying a coating to a workpiece, the nozzle assembly comprising:

a housing defining a nozzle opening through a length thereof and centered about an axis defined by the housing, a nozzle disposed in the nozzle opening and extending substantially through the length of the housing, the nozzle defining a gas conduit extending through a length thereof and having an inlet and an outlet at opposing ends thereof, the inlet for receiving a carrier medium from a thermal spray apparatus, a material feed opening in communication with the gas conduit proximate the outlet end thereof, the housing and the nozzle cooperating to define the material feed opening such that the material feed opening extends through a sidewall of each of the housing and the nozzle, the material feed opening being angularly disposed relative to the gas conduit, the outlet end of the nozzle being proximate a juncture of the gas conduit and the material feed opening such that coating material injected into the gas conduit through the material feed opening is heat-softened and propelled towards a workpiece to be coated by the carrier medium flowing outwardly from the nozzle, wherein the housing further defines at least two air passages aligned substantially parallel to the gas conduit and spaced apart from and on opposing sides thereof, the air passages each including an inlet attachable to a source of pressurized air, and an outlet extending through the housing on opposing sides of the outlet of the nozzle.

2. The nozzle assembly of claim 1 wherein the nozzle does not include a plasma/particle confinement zone downstream of the juncture of the gas conduit and the material feed opening.

3. The nozzle assembly of claim 1 wherein the juncture of the gas conduit and the material feed opening is about 0.300 inches from the outlet end of the nozzle.

4. The nozzle assembly of claim 1 wherein an outer surface of the nozzle assembly defines a tapered surface converging toward the axis of the housing at an outlet end of the housing.

5. A nozzle assembly for use with a thermal spray apparatus for applying a coating to a workpiece, the nozzle assembly comprising:

a housing defining a nozzle opening through a length thereof and centered about an axis defined by the housing, a nozzle disposed in the nozzle opening and extending substantially through the length of the housing, the nozzle defining a gas conduit extending through a length of the nozzle and having an inlet and an outlet at opposing ends thereof, the inlet for receiving a carrier medium from a thermal spray apparatus, a material feed opening in communication with the gas conduit proximate the outlet end thereof, the housing and the nozzle cooperating to define the material feed opening such that the material feed opening extends through a sidewall of each of the housing and the nozzle, the material feed opening being angularly disposed relative to the gas conduit, and the housing further comprising a tapered portion at an outlet end thereof converging towards the outlet of the nozzle for facilitating use of the nozzle assembly in close proximity to a workpiece and angularly disposed with respect thereto, wherein the housing further defines at least two air passages aligned substantially parallel to the gas conduit and spaced apart from and on opposing sides thereof, the air passages each including an inlet attachable to a source of pressurized air, and an outlet extending through the housing on opposing sides of the outlet of the nozzle.

6. The nozzle assembly of claim 5 wherein the nozzle includes a tip portion defining a throat substantially aligned with the gas conduit and including an angular inlet for providing a smooth transition for a carrier medium entering the nozzle tip from the gas conduit.

7. The nozzle assembly of claim 5 wherein the nozzle includes a tip portion manufactured from a material having a hardness greater than that of the material of the nozzle.

8. The nozzle assembly of claim 5 wherein the nozzle does not include a plasma/particle confinement zone downstream of a juncture of the material feed opening and the gas conduit.

9. A nozzle assembly for use with a thermal spray apparatus for applying a coating to a workpiece, the nozzle assembly comprising:

a housing defining a nozzle opening through a length thereof and centered about an axis defined by the housing, a nozzle disposed in the nozzle opening and extending substantially through the length of the housing, the nozzle defining a gas conduit extending through a length thereof and having an inlet and an outlet at opposing ends of the nozzle, the inlet for receiving a carrier medium from a thermal spray apparatus, a material feed opening in communication with the gas conduit proximate the outlet end thereof, the housing and the nozzle cooperating to define the material feed opening such that the material feed opening extends through a sidewall of each of the housing and the nozzle, the material feed opening being angularly disposed relative to the gas conduit, and the housing further defining at least two air passages aligned substantially parallel to the gas conduit and spaced apart from and on opposing sides thereof, the air passages each including an inlet attachable to a source of pressurized air, and an outlet extending through the housing on opposing sides of the outlet of the nozzle, the air passages for conveying pressurized air towards a workpiece adjacent a carrier medium and coating material flowing out of the nozzle.

10. The nozzle assembly of claim 9 wherein the outlet end of the nozzle is proximate a juncture of the gas conduit and the material feed opening such that coating material injected into the gas conduit through the material feed opening is heat-softened and propelled towards a workpiece to be coated by the carrier medium flowing outwardly from the nozzle.

11. The nozzle assembly of claim 10 wherein the nozzle does not include a plasma/particle confinement zone downstream of the juncture of the gas conduit and the material feed opening.

12. The nozzle assembly of claim 9 wherein an outer surface of the housing defines a tapered surface converging toward the axis of the housing at an outlet end thereof.

13. The nozzle assembly of claim 9 wherein the nozzle further comprises a tip portion manufactured from a material having a hardness greater than that of the material of the nozzle.

14. A nozzle assembly for use with a thermal spray apparatus for applying a coating to a workpiece, the nozzle assembly comprising:

a housing defining a nozzle opening through a length thereof and centered about an axis defined by the housing, a nozzle disposed in the nozzle opening and extending substantially through the length of the housing, the nozzle defining a gas conduit extending through a length thereof and having an inlet and an outlet at opposing ends thereof, the inlet for receiving a carrier medium from a thermal spray apparatus, a material feed opening in communication with the gas conduit proximate the outlet end thereof, the housing and the nozzle cooperating to define the material feed opening such that the material feed opening extends through a sidewall of each of the housing and the nozzle, the material feed opening being angularly disposed relative to the gas conduit, and a nozzle tip defining a throat throughout a length thereof and disposed in the gas conduit at the outlet end thereof, the nozzle tip defining a material port through a sidewall thereof in communication with the throat and the material feed opening of the nozzle, the material port being proximate an outlet end of the nozzle tip such that a coating material injected into a plasma stream via the material port will be heated by the plasma stream substantially beyond the outlet end of the nozzle tip.

15. The nozzle assembly of claim 14 wherein the nozzle tip further defines an angled inlet to the throat thereof.

16. A nozzle assembly for use with a thermal spray apparatus for applying a coating to a workpiece, the nozzle assembly comprising:

a housing defining a nozzle opening through a length thereof and centered about an axis defined by the housing, a nozzle disposed in the nozzle opening and extending substantially through the length of the housing, the nozzle defining a gas conduit extending through a length of the nozzle and having an inlet and an outlet at opposing ends thereof, the inlet for receiving a carrier medium from a thermal spray apparatus, a material feed opening in communication with the gas conduit proximate the outlet end thereof, the housing and the nozzle cooperating to define the material feed opening such that the material feed opening extends through a sidewall of each of the housing and the nozzle, the material feed opening being angularly disposed relative to the gas conduit, and the housing further comprising a tapered portion at an outlet end thereof converging towards the outlet of the nozzle for facilitating use of the nozzle assembly in close proximity to a workpiece and angularly disposed with respect thereto, wherein the nozzle includes a tip portion defining a throat throughout a length thereof and disposed in the gas conduit at the outlet end thereof, the throat is substantially aligned with the gas conduit, includes an angular inlet for providing a smooth transition for a carrier medium entering the tip portion from the gas conduit and defines a material port through a sidewall thereof in communication with the throat and the material feed opening of the nozzle, and the material port is proximate an outlet end of the tip portion such that a coating material injected into a plasma stream via the material port will be heated by the plasma stream substantially beyond the outlet end of the tip portion.

17. The nozzle assembly of claim 1 wherein the nozzle includes a tip portion defining a throat substantially aligned with the gas conduit and including an angular inlet for providing a smooth transition for a carrier medium entering the nozzle tip from the gas conduit.

* * * * *